US010316613B2

(12) United States Patent
Spitz et al.

(10) Patent No.: US 10,316,613 B2
(45) Date of Patent: Jun. 11, 2019

(54) STINGER WITH METAL C-RING SEAL

(71) Applicant: AKER SOLUTIONS AS, Lysaker (NO)

(72) Inventors: Stuart Spitz, Oslo (NO); Lukasz Topolski, Asker (NO)

(73) Assignee: AKER SOLUTIONS AS, Lyasker (NO)

( * ) Notice: Subject to any disclaimer, the term of this patent is extended or adjusted under 35 U.S.C. 154(b) by 161 days.

(21) Appl. No.: 15/150,945

(22) Filed: Jun. 8, 2016

(65) Prior Publication Data

US 2017/0022775 A1 Jan. 26, 2017

(30) Foreign Application Priority Data

May 8, 2015 (NO) ..... 20150572

(51) Int. Cl.

| | |
|---|---|
| ***E21B 33/035*** | (2006.01) |
| ***E21B 33/04*** | (2006.01) |
| ***E21B 34/04*** | (2006.01) |
| ***E21B 33/12*** | (2006.01) |

(52) U.S. Cl.

CPC ..... *E21B 33/1212* (2013.01); *E21B 33/04* (2013.01); *E21B 34/04* (2013.01)

(58) Field of Classification Search

CPC ..... E21B 33/035; E21B 33/04; E21B 34/04; E21B 34/045; E21B 33/1212

USPC ..... 277/647

See application file for complete search history.

(56) References Cited

U.S. PATENT DOCUMENTS

| | | | | |
|---|---|---|---|---|
| 2,913,269 | A * | 11/1959 | Bremer et al. | F16J 9/20 277/500 |
| 4,290,614 | A | 9/1981 | Moll | |
| 4,658,847 | A | 4/1987 | McCrone | |
| 4,832,381 | A | 5/1989 | Boulton | |
| 5,015,016 | A | 5/1991 | Smith | |
| 5,105,879 | A | 4/1992 | Ross | |
| 2013/0092023 | A1* | 4/2013 | Potter | F04B 39/125 92/171.1 |
| 2013/0193650 | A1* | 8/2013 | Tohdoh | F16J 15/08 277/590 |

FOREIGN PATENT DOCUMENTS

| | | | |
|---|---|---|---|
| GB | 2214543 | A | 9/1989 |
| WO | 2007050618 | A | 5/2007 |
| WO | 2007050618 | A1 | 5/2007 |

OTHER PUBLICATIONS

Great Britain Search Report dated Oct. 11, 2016 for International Application GB1607640.8.

* cited by examiner

*Primary Examiner* — Cathleen R Hutchins
(74) *Attorney, Agent, or Firm* — Avery N. Goldstein; Blue Filament Law PLLC

(57) ABSTRACT

An oilfield tubular, such as a stinger (1), designed to be installed in a tubing hanger (2) in an XMT (Christmas tree) located on the sea bed, is presented. The oilfield tubular (1) is exposed to the production bore (4) pressure, and includes axial sealing means (6) located on an end (1*a*) of the tubular (1). The axial sealing means (6) includes a metal c-ring seal (6*a*), which metal c-ring seal (6*a*) is smaller in cross section than the thickness ($t_1$) of the oilfield tubular wall (1*c*). The opening (6*b*) of the metal c-ring seal (6*a*) is facing the high pressure side of the production bore (4). This pressure tend to expand the c-profile to firm engagement with contacting surfaces.

13 Claims, 4 Drawing Sheets

STINGER WITH METAL C-RING SEAL

The present invention is to be used in the oil and gas industries, and relates to an axial sealing means located on an end surface of a tubular or similar, such as a stinger, designed to be installed in a tubing hanger in an XMT (Christmas tree) located on the sea bed, which oilfield tubular is exposed to the production bore pressure.

In an oil or gas well, a stinger assembly may be attached to the lower end of an upper section of tubing to provide a releasable sealed connection with a well tool such as a tubing hanger or packer or the like which supports a lower section of tubing in the well. When installing the well tool in the well, it is desirable that the stinger be locked against separation from the well tool but, once the well tool is anchored in its desired position in the well, it may become necessary to disconnect the stinger from the well tool to allow the upper section of tubing to be pulled from the well for servicing. Apparatus connected to the tubing at the wellhead may make it desirable to be able to disconnect the stinger from the well tool without having to rotate the tubing or slide the upper section of tubing downwardly within the well.

BACKGROUND OF THE INVENTION

When installing a stinger assembly into a bore in a tubing hanger (TH), there are some compromises to consider which is discussed below. Increasing production bore size reduces space through the tubing hanger for the annulus bore; this reduces available annulus flow area. In order to achieve an acceptable flow area in a reduced bore annulus stinger, it is typical to split the annulus bore into 2 separate smaller stingers. This is unfavourable from a reliability perspective amongst others.

The ideal solution is to reduce the cross-section of the stinger wall in order to obtain the desired flow area within the available space, but conventionally used metal lip seals do not allow a sufficiently thin cross-section. Stinger integral metal bump seals, which allow a thin cross-section, do not flex sufficiently to make reliable seals and replacement of such a seal on a completed XT assembly at typical small diameters, is a costly task as the whole stinger must be removed.

According to the present invention an oilfield tubular of the introductory said kind is provided, which is distinguished in that the oilfield tubular includes axial sealing means located on an end surface of the oilfield tubular, which sealing means includes a metal c-ring seal, which seal is smaller in cross section than the thickness of the oilfield tubular wall and the opening of the metal c-ring seal is facing the high pressure side of the production bore, which pressure tend to expand the c-profile to firm engagement with contacting surfaces.

Thus the invention relates to the use of an axial sealing means, i.e. an axial sealing between 2 parallel bores. To provide such sealing, the proposed metal c-ring seal is used on the stinger, as opposed to a metal lip-seal. These seals can be made in extremely small cross-sections and thus enable a very thin section stinger.

Preferably, the opening of the metal c-ring seal is facing in the axial direction of the oilfield tubular and away from said oilfield tubular.

Preferably, the axial sealing means on the end surface of the oilfield tubular includes an external ledge or shoulder on the end surface, which shoulder supports the metal c-ring seal.

Preferably the metal c-ring seal makes sealing contact with a bore wall in the tubing hanger which is adapted to receive the oilfield tubular, in addition to make sealing contact with an external surface of the oilfield tubular, which external surface is part of the shoulder and is opposing the bore wall.

Normally, the metal c-ring seal is less than 1-5 mm in cross section.

When using these seals at small cross-sections (e.g. 1-3 mm or even 5 mm) the c-ring gets extremely stiff if the body of the seal is designed to resist normal pressures used for XT systems. A stiff seal is typically not a reliable seal unless seal bore tolerances are reduced to uneconomic levels.

In one embodiment the oilfield tubular shoulder may include a V or U shaped seat, which seat is designed to receive and support the metal c-ring seal.

Therefore a design is proposed where the c-ring is made thinner than it typically needs to be to handle the pressure rating, thus allowing it to be more resilient to tolerance variations. This is combined with the V or U shaped seat provided in the stinger which supports the thin seal and allows it to handle a higher pressure rating.

A similar c-ring seal is used with electrical and hydraulic connectors through the TH. To our knowledge, metal c-rings have never been used in this application and this is attributed to the excessive tight tolerances required, or the inability for typical flat seated c-rings to handle the pressure—a problem that this design solves.

Using the c-ring on the annulus (or production) stinger and adding a U or V shaped seat will improve pressure rating and reduce tolerance sensitivity.

The c-ring operates like a normal lip seal and that is how it is used in most applications. Specifically for this application it works because of (a) small size to achieve the required stinger envelope (b) thin section material to make the seal flexible allowing manufacturing tolerances that can be reliably machined (c) u shaped seat that supports the c-ring against pressure.

With a normal flat seat behind the c-ring pressure tries to make the c-ring go a square shape. The effect of this is that after pressure application the seal is permanently deformed and loses contact preload between the surfaces being sealed unless the material thickness is sufficient to avoid plastic damage.

The U shaped seat supports the seal and means that it cannot be forced by pressure into a square shape. Therefore a thinner than usual seal can be used thus obtaining the benefit (b) given above.

Any typical corrosion resistant alloy can be used here. The seal is very slightly deformed if installed at tolerance extremes and some further small deformation does occur with initial pressure application but after this the c-ring operates in an elastic regime. The seal can be re-used in theory since these deformations are extremely small when compared to the seal interference with its sealing surfaces.

Thus the metal c-ring seal may preferably be made of a corrosion resistant alloy, such as Inconel.

On one embodiment the metal c-ring seal has a wall thickness in the range of 0.01 to 0.25 mm.

On one embodiment the shoulder is an angular notch, preferably a 90 degree notch. This shoulder may be defined by one transversally extending surface and one axially extending surface, both surfaces supporting the metal c-ring seal.

EXAMPLE OF EMBODIMENT

While the various aspects of the present invention has been described in general terms above, a more detailed and non-limiting example of an embodiment will be described in the following with reference to the drawings, in which.

Figure 1:
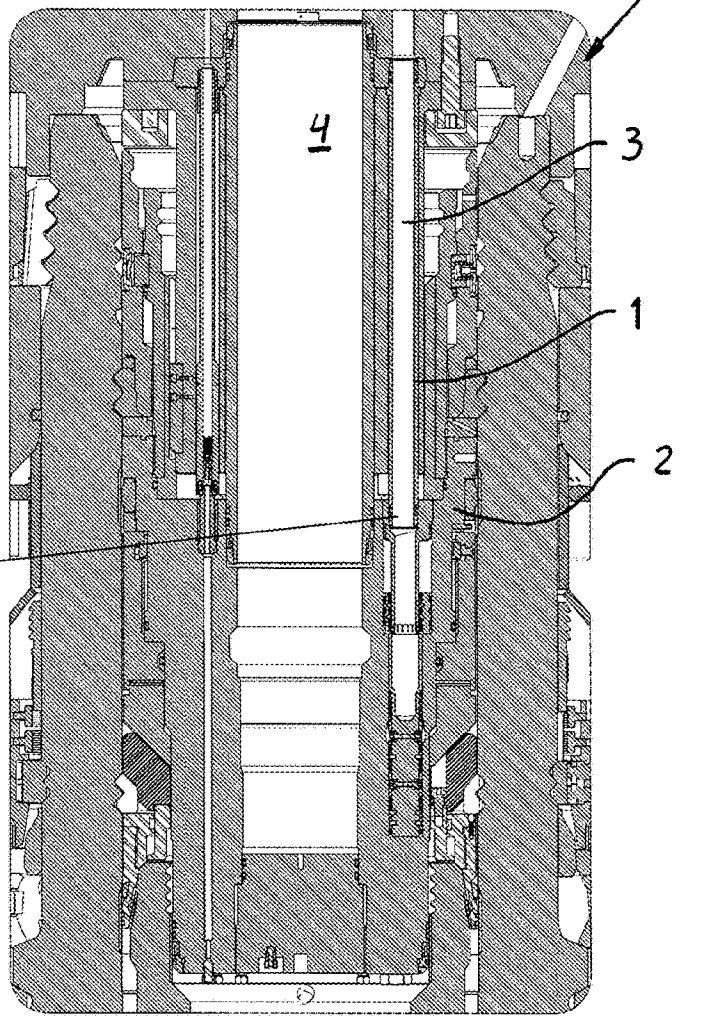
FIG. 1 is a sectional view of a typical tubing hanger and a stinger installed into it in an arrangement involving the present invention.

Reference is first made to FIG. 1 showing in general a tubing hanger 2 installed in a wellhead 5 located in a Christmas tree (XMT) on the seabed. These components are well known per se and will not be described in further detail. A stinger 1 is installed in the tubing hanger 2 and provides an independent flow path 3 external to the main flow bore 4 through the wellhead 5. The flow path 3 of the stinger 1 may be used, as an example, to supply fluid or gas from the surface to the well flow to provide gas lift to the produced flow.

Figure 2:
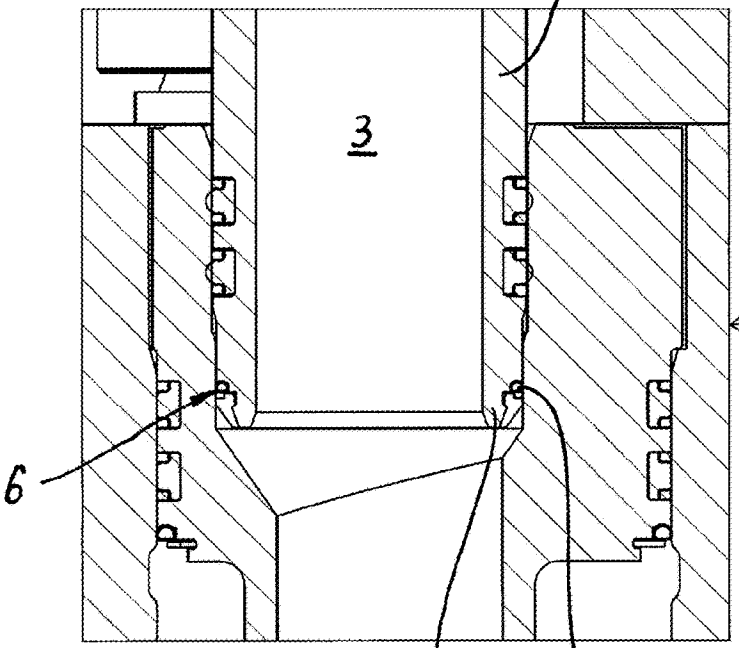
FIG. 2 is an enlarged view of the lower end of the stinger which includes the c-ring seal on its end surface.

Reference is now made to FIG. 2, which is an enlarged view of the lower end area of the stinger 1 in FIG. 1. The stinger 1 includes axial sealing means 6 located at the lower end 1*a* of the stinger 1. This axial sealing means 6 includes a metal c-ring seal 6*a*. Further, the axial sealing means 6 at the lower end 1*a* of the stinger 1 includes an external ledge 1*b*, or shoulder, which is more clearly shown in FIG. 3. The shoulder 1*b* supports the metal c-ring seal 6*a*.

Figure 3:
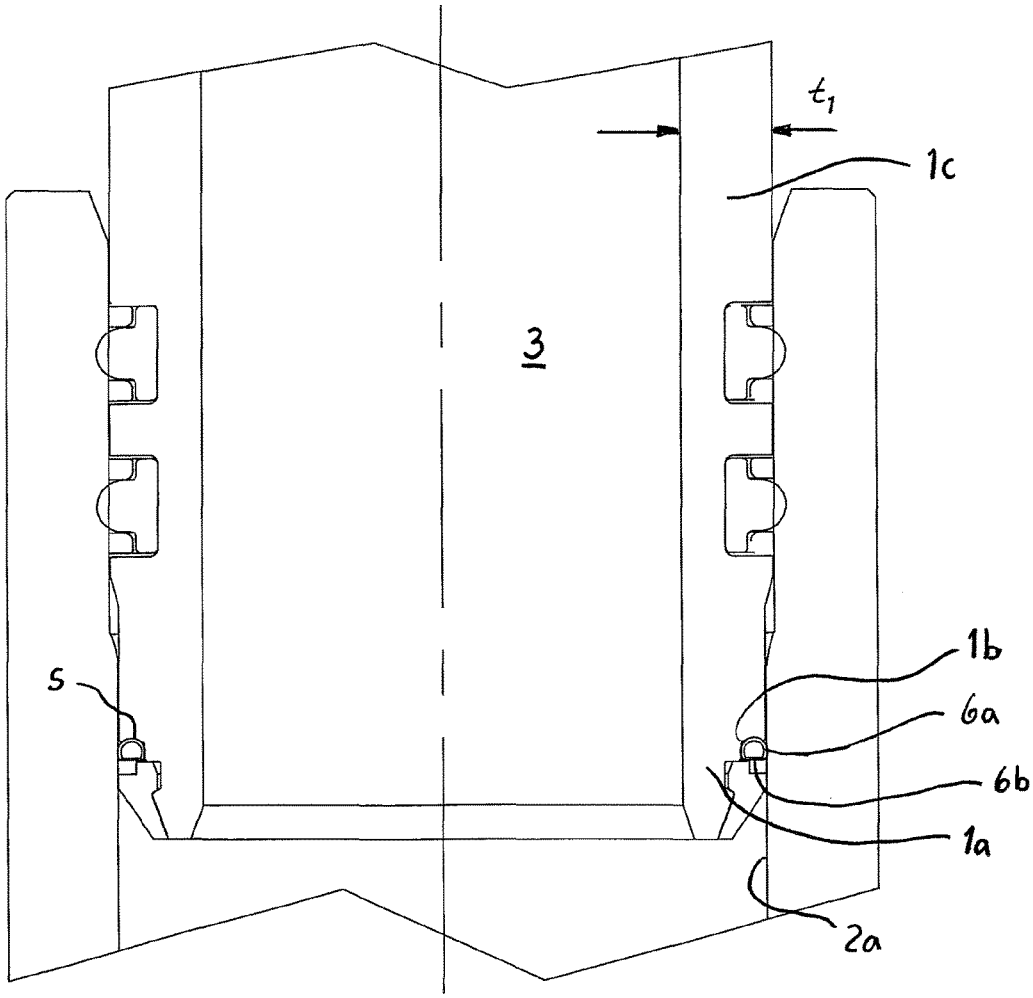
FIG. 3 is a still more enlarged view of the lower end of the stinger shown in FIG. 2, and FIG. 4A-4D show seated and unseated c-ring deformations.

As shown in FIG. 3 and still more detailed in FIG. 4A to 4D, the shoulder 1*b* is defined by one transversally extending surface 1*b*' and one axially extending surface 1*b*". Both surfaces 1*b*' and 1*b*" support the metal c-ring seal 6*a*. In addition, the metal c-ring seal 6*a* makes contact with the bore wall 2*a* in the tubing hanger 2. The shoulder surfaces 1*b*' and 1*b*" is typically like an angular notch, normally a 90 degree angle between the surfaces 1*b*' and 1*b*".

The opening 6*b* of the metal c-ring seal 6*a* is installed in such a way that the opening 6*b* is exposed to the high pressure side of the production bore 4. When the metal c-ring seal 6*a* is exposed to such high pressure at the opening 6*b*, the high pressure tend to expand the c-profile to firm engagement with contacting surfaces, i.e. the supporting shoulder surfaces 1*b*' and 1*b*" and the bore wall 2*a*.

Normally, this means that the opening 6*b* of the metal c-ring seal 6*a* is facing in the axial direction of the stinger 1 and away from the stinger 1. This also means that the sealing means 6 is smaller in cross section than the thickness $t_1$ of the stinger wall 1*c*.

The shoulder 1*b*, or ledge, of the stinger 1 will normally include either a V or a U shaped seat s. The seat s is designed to receive and support the metal c-ring seal 6*a*. Normally, such seat s will be provided in the transversally extending shoulder surface 1*b*'. However, it would be possible also to provide such seat in the axially extending shoulder surface 1*b*", and even the bore wall 2*a*.

The theory behind this design and function is further detailed below with reference to FIG. 4A to 4D.

Typically, the metal c-ring seal 6*a* is less than 1-5 mm in thickness cross section. A typical diameter of the metal c-ring seal for use on a stinger 1 can have a diameter of 38 mm and a cross section "diameter" of about 1.6 mm, without such dimensions being any limitation, only mentioned as an example for the proposed stinger 1. The metal c-ring seal 6*a* is typically made of a corrosion resistant alloy, such as Inconel. Inconel 625 and Inconel 718 are examples of suitable grades. The metal c-ring seal 6*a* may have very thin walls and may typically have a wall thickness $t_2$ in the range of 0.01 to 0.25 mm.

With reference again to FIG. 4A to 4D, FIG. 4A shows the metal c-ring seal 6*a* supported in the shoulder seat s in the transversally extending support surface 1*b*', which provides a safe and controllable support for the metal c-ring seal 6*a*. Arrows R indicate that the U-seat with short unsupported length is stable over pressure cycling shown by arrows P.

Figure 4A:
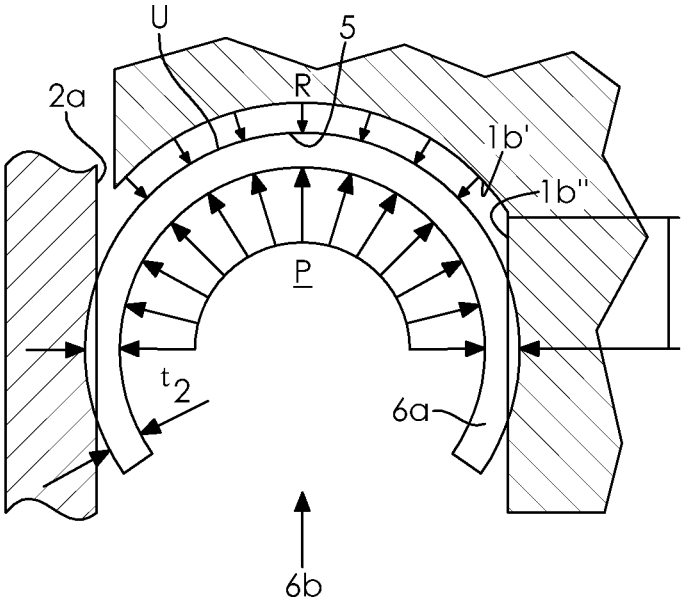
Figure 4B:
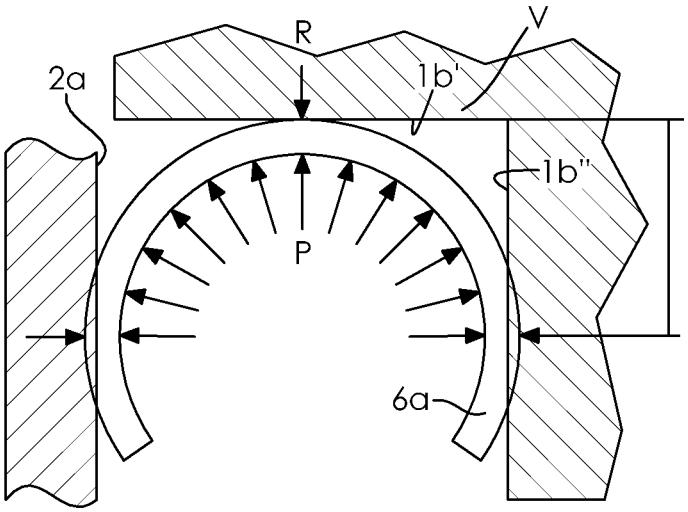

FIG. 4B shows the metal c-ring seal 6*a* supported only along a line in the transversally extending support surface 1*b*', which provides an unstable and poorly controllable support for the metal c-ring seal 6*a*. The arrows R indicate that the ring thickness now is insufficient to withstand pressure, shown by arrows P, over the unsupported length.

Figure 4C:
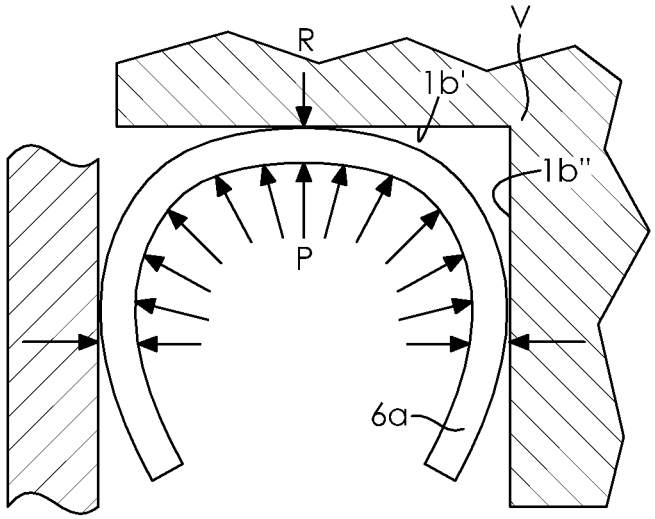

FIG. 4C shows the metal c-ring seal 6*a* supported in the transversally extending support surface 1*b*'. The arrows R indicate that the pressure, shown by arrows P, plastically deforms the metal c-ring seal 6*a*.

Figure 4D:
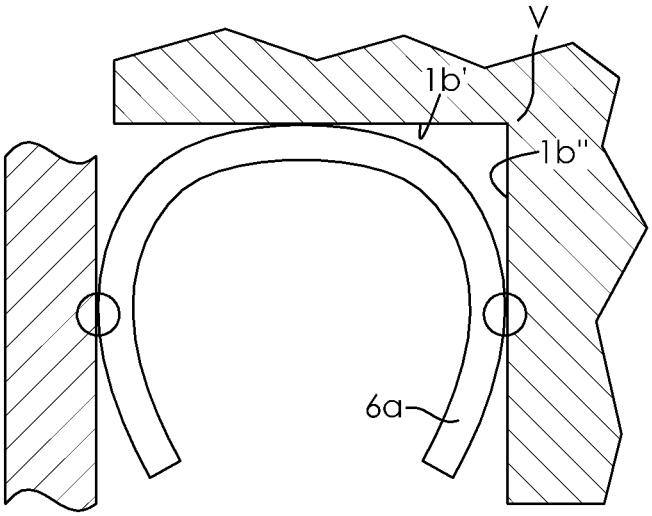

FIG. 4D shows the metal c-ring seal 6*a* supported in the transversally extending support surface 1*b*'. The arrows indicate loss of sealing after pressure removal.

Thus we may say that the metal c-ring seal 6*a* operates like a normal lip seal and that is how it is used in most applications. We repeat that specifically for this application it works because of:

(a) small size to achieve the required stinger envelope
(b) thin section material to make the seal flexible allowing manufacturing tolerances that can be reliably machined
(c) u shaped seat that supports the c-ring against pressure.

As mentioned, with a normal flat seat behind the metal C-ring, the pressure tries to make the c-ring go a square shape. The effect of this is that after pressure application, the metal c-ring seal is permanently deformed and loses contact preload between the surfaces being sealed unless the material thickness is sufficient to avoid plastic deformation and damage.

The U or V shaped seat will support the metal c-ring seal and provides for that the seal cannot be forced by pressure into a square shape. Therefore a thinner than usual metal c-ring seal 6*a* can be used and thus obtaining the benefit (b) given above.

As mentioned, the metal c-ring seal 6*a* is very slightly deformed if installed at tolerance extremes. Some further small deformation does occur with initial pressure application, but after this the metal c-ring seal 6*a* operates in an elastic regime. The metal c-ring seal 6*a* can be re-used in theory since these deformations are extremely small when compared to the seal interference with its sealing surfaces.

Thus it is to be understood that without support from the U or V shaped seat s, the thin section c-ring is deformed by pressure and loses ability to seal after one cycle.

This would require a thicker ring which cannot be made so small and is more sensitive to tolerances, making a less robust seal that is more expensive due to much reduced tolerances on mating parts.

The invention claimed is:

1. An oilfield tubular designed to be installed in a tubing hanger in an XMT (Christmas tree) located on the sea bed, said oilfield tubular is exposed to a production bore pressure, said oilfield tubular comprising: axial sealing means located on an end of said oilfield tubular, said axial sealing means includes a metal c-ring seal and an external shoulder at said end, said shoulder defined by a transversely extending surface and an axially extending surface, said transversely extending surface defining a V or U shaped seat, both surfaces supporting said metal c-ring seal, wherein said metal c-ring seal is smaller in cross section than a thickness ($t_1$) of an oilfield tubular wall and an opening of said metal c-ring seal is facing a high pressure side of the production bore, the production bore pressure permanently deformably expands a c-profile of said metal c-ring seal to form a sealed engagement with contacting surfaces upon initial pressurization, said V or U shaped seat configured to support said metal c-ring seal and limit further permanent deformation of said metal c-ring seal allowing said metal c-ring seal to operate in an elastic regime to maintain sealed contact with the contacting surfaces and form sealing contact with a bore wall in the tubing hanger which is adapted to receive the oilfield tubular, in addition to make sealing contact with an external surface of the oilfield tubular, which external surface is part of the shoulder and is opposing the bore wall.

2. The oilfield tubular according to claim 1, wherein said opening of said metal c-ring seal is aligned in the axial direction of said oilfield tubular and facing away from said oilfield tubular.

3. The oilfield tubular according to claim 2, wherein said metal c-ring seal makes sealing contact with a bore wall in said tubing hanger adapted to receive said oilfield tubular, in addition to sealing contact with an external surface of said oilfield tubular, said external surface is part of said shoulder and is opposing said bore wall.

4. The oilfield tubular according to claim 1, wherein said metal c-ring seal makes sealing contact with a bore wall in said tubing hanger adapted to receive said oilfield tubular, in addition to sealing contact with an external surface of said oilfield tubular, said external surface is part of said shoulder and is opposing said bore wall.

5. The oilfield tubular according to claim 1, wherein said metal c-ring seal is less than 5 mm in thickness cross section.

6. The oilfield tubular according to claim 1, wherein said metal c-ring seal is made of a corrosion resistant alloy.

7. The oilfield tubular according to claim 6, wherein the corrosion resistant alloy is Inconel.

8. The oilfield tubular according to claim 1, wherein said metal c-ring seal has a wall thickness ($t_2$) in the range of 0.01 to 0.25 mm.

9. The oilfield tubular according to claim 1, wherein said shoulder is an angular notch.

10. The oilfield tubular according to claim 1, wherein said shoulder is a 90 degree notch.

11. The oilfield tubular according to claim 1, wherein said metal c-ring seal operates in an elastic regime where deformations are extremely small when compared to a seal interference of said metal c-ring seal with the contacting surfaces to be sealed.

12. The oilfield tubular according to claim 1, wherein said U or V shaped seat supports said metal c-ring seal along at least 30% of said metal c-ring seal's circumference.

13. The oilfield tubular according to claim 1, wherein said metal c-ring seal is permanently deformed at its center.

* * * * *